US007404532B1

(12) United States Patent
Baril

(10) Patent No.: US 7,404,532 B1
(45) Date of Patent: Jul. 29, 2008

(54) SAFETY GATE MOUNTING KIT

(76) Inventor: Jeffrey Baril, 13 Alexander Rd. #5, Billerica, MA (US) 01821

( * ) Notice: Subject to any disclaimer, the term of this patent is extended or adjusted under 35 U.S.C. 154(b) by 0 days.

(21) Appl. No.: 11/712,756

(22) Filed: Mar. 1, 2007

Related U.S. Application Data

(63) Continuation-in-part of application No. 10/961,618, filed on Oct. 8, 2004, now abandoned.

(60) Provisional application No. 60/511,469, filed on Oct. 16, 2003.

(51) Int. Cl.
*E04G 5/06* (2006.01)
*E04H 17/16* (2006.01)

(52) U.S. Cl. ..... 248/218.4; 248/231.41; 256/73

(58) Field of Classification Search ..... 248/218.4, 248/219.1, 229.1, 229.12, 229.22, 227.3, 248/231.41; 256/26, 73; 49/394, 503
See application file for complete search history.

(56) References Cited

U.S. PATENT DOCUMENTS 1,283,359 A * 10/1918 Thomson ..... 49/381
1,798,613 A * 3/1931 Manson ..... 248/218.4
2,651,806 A * 9/1953 Thompson ..... 16/253
2,763,890 A * 9/1956 Cox ..... 16/253
3,064,305 A * 11/1962 Hill ..... 16/252
3,811,149 A * 5/1974 Griffin ..... 16/240
4,047,332 A * 9/1977 Benoit ..... 49/236
4,729,149 A * 3/1988 Brunkan ..... 16/252
5,360,191 A * 11/1994 Carson et al. ..... 248/218.4
5,593,141 A * 1/1997 Cain et al. ..... 256/26
6,802,106 B2 * 10/2004 Taglianetti ..... 16/246

* cited by examiner

*Primary Examiner*—Korie H. Chan
(74) *Attorney, Agent, or Firm*—William Nitkin

(57) ABSTRACT

A safety gate mounting kit is disclosed for use in the installation of a safety gate to a post, such as a newel post or similar structure, such kit having a first pair of clamping members for attachment to a top portion of a rectangular post and a second pair of clamping members for attachment to a lower portion of a rectangular post. First and second round post adapters for positioning around opposite sides of a round section of the post are provided for insertion between one pair of the clamping members. A wooden gate attachment member is provided to be attached to the first and second clamping members to which wooden gate attachment member the assembly/attachment hardware of a safety gate can be attached.

6 Claims, 4 Drawing Sheets

SAFETY GATE MOUNTING KIT

This application is a continuation-in-part of my prior application entitled Safety Gate Mounting System, Ser. No. 10/961,618 filed Oct. 8, 2004, now abandoned, which claimed priority and benefit of a provisional patent application entitled Safety Gate Mounting System, Ser. No. 60/511,469 filed Oct. 16, 2003.

BACKGROUND OF THE INVENTION

1. Field of the Invention

The kit of this invention resides in the area of safety gates and more particularly relates to a device sold in kit form for assembly and mounting on a newel post or similar structure to which device a safety gate can be mounted to retain a child or pet within a designated area.

2. History of the Prior Art

Safety gates are well known for keeping young children and pets within certain areas and for preventing them from traveling to areas where they should not go. Safety gates come in a variety of styles and types, and many are hingeably attached at one side and open and close at the other side where they can be locked. Some safety gates extend across openings. Safety gate manufacturers build child safety gates with the assumption that their gates will be installed on a vertical flat surface which is not normally provided at the top of stairwells where a newel post may be present. Most newel posts have sections that are round, square, rectangular or a combination of these and/or other shapes.

SUMMARY OF THE INVENTION

A problem in the prior art concerns the attachment of a safety gate to a newel post or similar structure, hereafter referred to as a post or newel post, without damaging the post, such as by drilling holes into the post. Many newel posts are made of carefully finished wood and some are highly decorated, and homeowners do not want to damage them by attaching a safety gate directly to them. Thus it is an object of this invention to provide a safety gate mounting kit which can be mounted to a newel post or other similar structure having many different shaped sections which can be either round, square, rectangular or a combination of theses and/or other shapes without damaging the post and yet still be adjustable to the newel post's particular shape.

The safety gate mounting kit of this invention includes a wooden gate attachment member, having first and second sides opposite to one another, that is vertically disposed for alignment with the newel post to which wooden gate attachment member the safety gate's assembly/attachment hardware is attached according to the directions of the safety gate manufacturer. Prior art gate mounting systems have utilized brackets or other attachment means which are screwed into position on the newel posts themselves, causing damage from screw holes related to such mounting systems.

It is a still further object of this invention to provide a kit having two pairs of easy-to-mount first and second clamps. One pair of first and second clamps is secured to an upper portion of a newel post, and the other pair of first and second clamps is secured to a lower portion. These first and second clamps, being substantially U-shaped, can encircle a section of a newel post that is, for example, rectangular. The kit further includes at least one pair of first and second round post adapters which can be inserted between one pair of first and second clamps, thereby allowing the round post adapters to encircle a section of a newel post that is rounded. The first side of the wooden gate attachment member is then attached to the outer side of the first clamp of each pair of the first and second clamps, and the safety gate is then attached to the second side of the wooden gate attachment member. Thus the safety gate mounting kit of this invention allows a safety gate to be attached to a newel post having different shaped sections without damaging the newel post.

DESCRIPTION OF THE PREFERRED EMBODIMENT(S)

Figure 1:
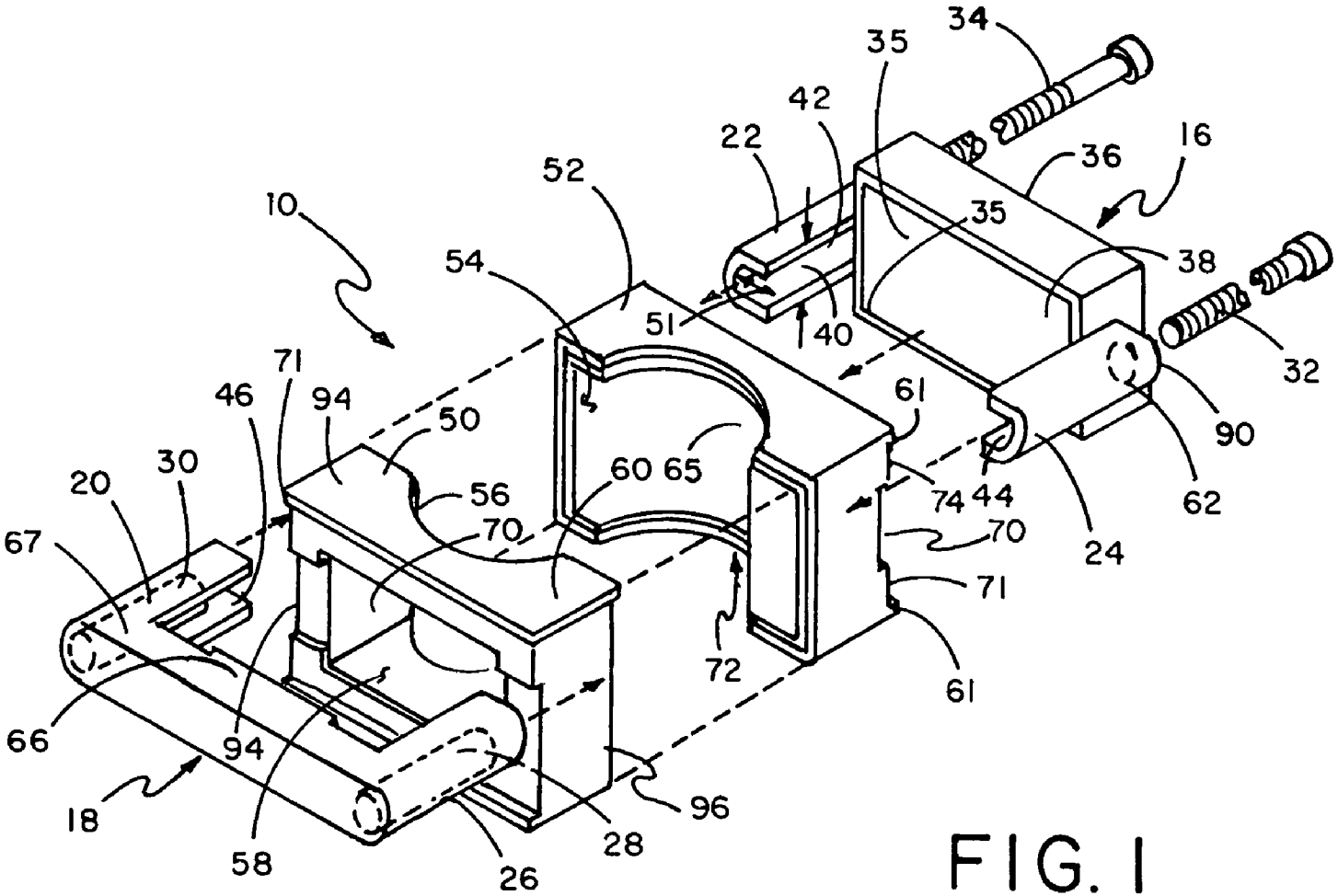
FIG. 1 illustrates an exploded perspective view of one embodiment of one pair of first and second clamps of the kit of this invention for mounting on a round section of a newel post.
Figure 4:
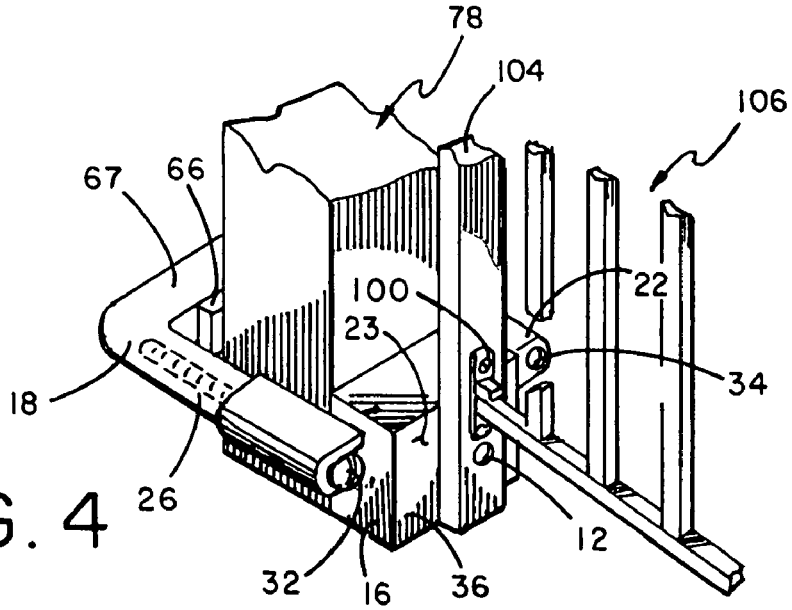
FIG. 4 illustrates a perspective view of the embodiment of FIG. 3 attached to a square section of a newel post at its lower portion and showing a safety gate attached to the wooden gate attachment member that is screwed to the outer side of the first clamp.
Figure 2:
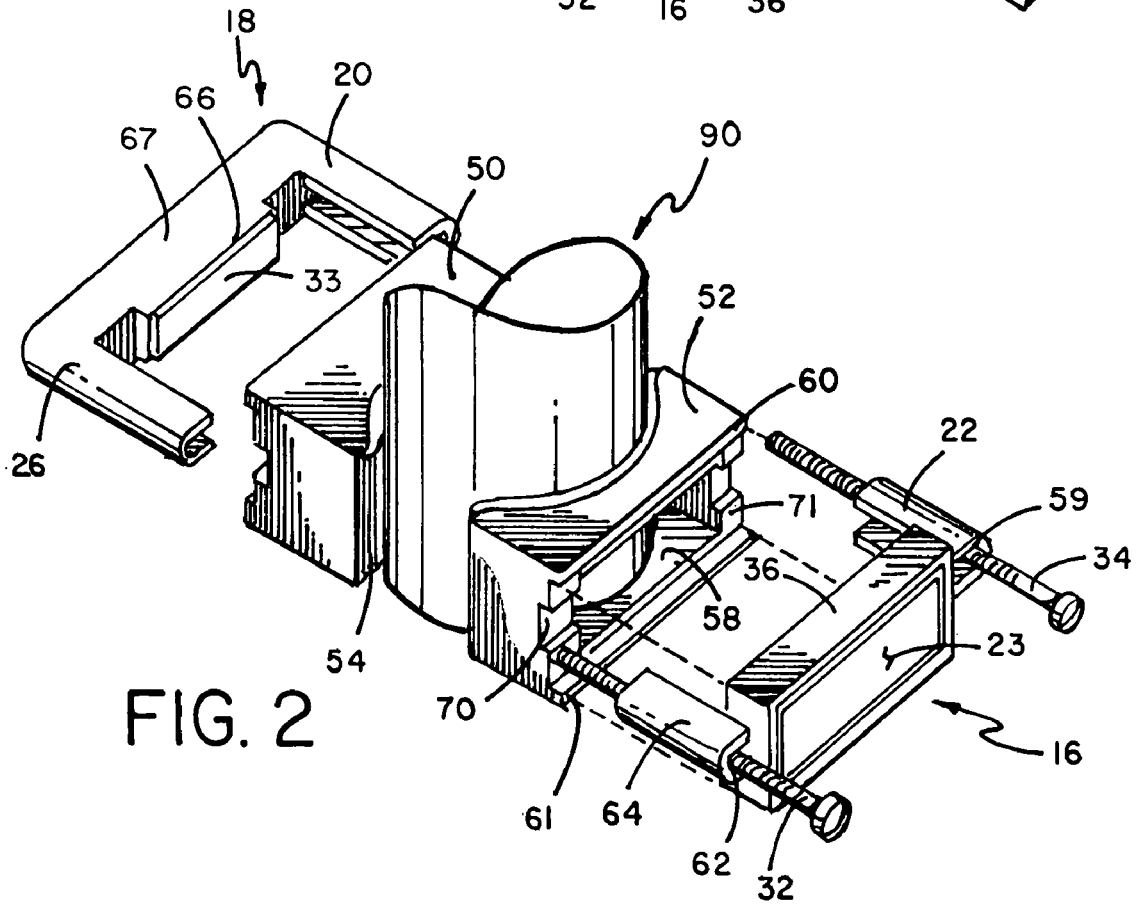
FIG. 2 illustrates a perspective view of the embodiment of FIG. 1 about to be attached to a round section of a newel post.
Figure 3:
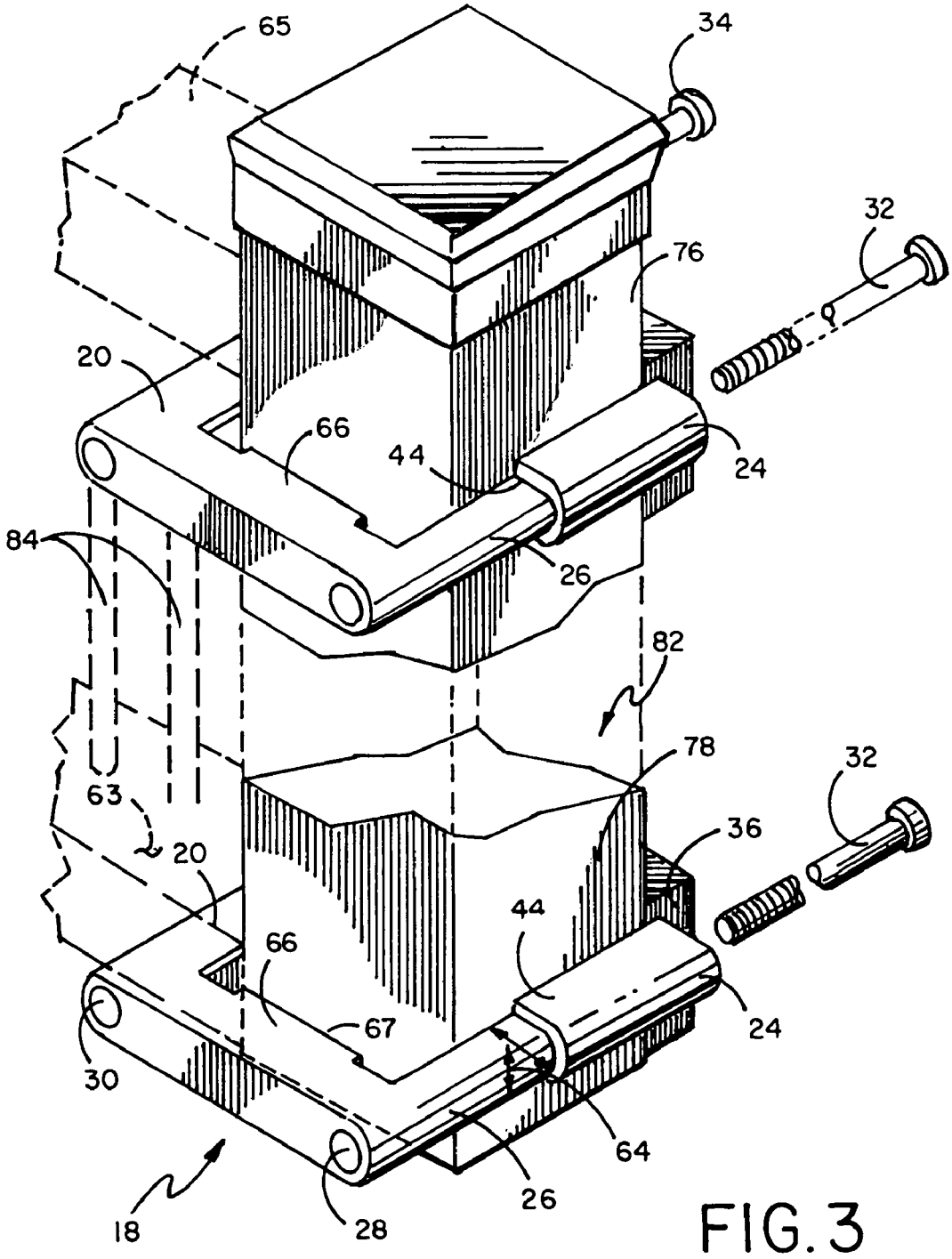
FIG. 3 illustrates a perspective view of another embodiment of the kit of this invention showing two pairs of first and second clamps, one pair about to be attached to an upper square portion of a newel post and the other pair about to be attached to a lower square portion of the newel post.

FIG. 1 illustrates an exploded perspective view of one embodiment of the kit 10 of this invention for mounting on a round newel post of a railing. First clamp 16 has first and second receipt members 22 and 24 which are attached, respectively, to the first and second sides of first clamp connector 36 to form a substantially U-shaped structure. A first receipt member aperture 59, seen in FIG. 2, and second receipt member aperture 62 are defined at the first ends, respectively, of each first and second receipt members 22 and 24. Within the inner side of first clamp connector 36 can be defined a centrally disposed aperture 35 for receipt of a snugly fitting piece of wood, being wooden insert 38 through which outer side 23 of first clamp connector 36, as seen in FIGS. 2 and 4, a mounting screw 12, as seen in FIG. 4, can be screwed when attaching wooden gate attachment member 104 to the outer side 23 of first clamp connector 36. First and second receipt member channels 42 and 44 are defined, respectively, in first and second receipt members 22 and 24. A second receipt member aperture 62 is shown defined at the first end of second receipt member 24 through which second bolt 32 enters and passes through second receipt member channel 44. A first receipt member aperture, as seen in FIG. 2, is defined at the first end of first receipt member 22 through which first bolt 34 enters and passes into first receipt member channel 42. The inner height 40 and inner width 51 of first receipt member channels 42 and the equivalent inner height and inner width of second receipt member channel 44 of first clamp 16 are greater than the outer height 64 and outer width 39, as seen in FIG. 3, of each of the first and second insert members 20 and 26 of second clamp 18 such that first and second insert members 20 and 26 can be inserted, respectively, into first and second receipt member channels 42 and 44 of first and second receipt members 22 and 24. Second clamp 18 has first and second insert members 20 and 26 connected to the first and second ends of second clamp connector 67 to form a substantially U-shaped structure. Second clamp connector 67 has a protrusion 66 having a flat surface extending outward from its inner side. In one embodiment the outer side of protrusion 66 can have a layer 33 of resilient cushioning, as seen in FIG. 2. Within first and second insert members 20 and 26 near their second ends are defined, respectively, first and second bolt receipt threaded apertures 30 and 28, as seen in FIG. 1. The distance between the inner sides of the first and second receipt members is the same as the distance between the inner sides of the first and second insert members. When the kit of this invention is to be mounted on a round section of a newel post, first and second round post adapters 52 and 50 each having an outer side and an inner side and being of similar construction, are positioned between first and second clamps 16 and 18 with their inner sides 72 facing opposite sides of a rounded section of the post. First and second round post adapters 52 and 50 each have first and second side members 94 and 96, first inner side 72 and second outer side 74, and a substantially concave portion 68 defined in first inner side 72, as seen in FIG. 1. The distance between the first and second side ends 94 and 96 of each of the first and second round post adapters is less than the distance between either the inner sides of the first and second receipt members or the distance between the inner sides of the first and second insert members. In one embodiment resilient cushioning 54 can cover and protrude from first inner side 72 of the round post adapters. Defined in second outer side 74 of each round post adapter is outer channel 71, forming upper lip 60 and lower lip 61. An inner channel 70 is further defined in outer channel 71. An opening 58 can be defined, if desired for manufacturing considerations, in second side 74 between first and second side members 94 and 96. When a pair of first and second clamps 16 and 18 with first and second round post adapters 52 and 50 positioned therebetween, as discussed above, is about to be mounted on a round section of a newel post, as illustrated in FIG. 2, round post 98 is positioned between resilient cushioning 54 of the first and second round post adapters 50 and 52. First and second insert members 20 and 26 of second clamp 18 extend, respectively, around first and second side members 94 and 96 and into first and second receipt member channels 42 and 44, allowing protrusion 66 to fit into inner channel 70 of second round post adapter 50 and enabling the top and bottom of first clamp connector 36 to fit within outer channel 71 between upper lip 60 and lower lip 61 of first round post adapter 52 to help hold the round post adapters in place. First and second bolts 34 and 32 are then passed, respectively, into first and second receipt member apertures 59 and 62 of first clamp 16, as best seen in FIG. 2, and then pass, respectively, through first and second receipt member channels 42 and 44, and, as seen in FIG. 2, are then screwed, respectively, into first and second bolt receipt threaded apertures 30 and 28 of first and second insert members 20 and 26, causing first and second round post adapters 52 and 50 to tighten securely around the round section of round post 98, as seen in FIG. 2.

FIG. 3 illustrates a perspective view of another embodiment of the kit of this invention showing two pairs of first and second clamps 16 and 18, one pair about to be attached to an upper square portion 76 of a newel post and the other pair about to be attached to a lower square portion 78 of the newel post. Balusters 84 and rails 63 and 65 are shown in dashed lines attached to the newel post. First and second round post adapters are not utilized in this embodiment.

When the kit of this invention is to be mounted on rectangular portions of a newel post, as illustrated in FIGS. 3 and 4, two pairs of first and second clamps 16 and 18 are fitted around opposite sides of the post, one pair at an upper portion and the other pair at a lower portion. As each pair of first and second clamps 16 and 18 is the same, only one pair will be described herein, that pair being the one attached to the lower portion of the rectangular post, as seen in FIG. 4. First, wooden insert 38, as seen in FIG. 1, of first clamp connector 36 of first clamp 16 is positioned adjacent to the side of the post to which safety gate 106 will be attached to wooden gate attachment member 104. Second clamp 18 is positioned on the opposite side of the post with protrusion 66 of second clamp connector 67 positioned adjacent to such opposite side. Protrusion 66 can have a layer of resilient cushioning 33, as seen in FIG. 2, thereon to prevent marring of the newel post. First and second insert members 20 and 26 extend, respectively, into first and second receipt member channels 42 and 44 of first and second receipt members 22 and 24, allowing wooden insert 38 of first clamp connector 36 to fit against one side of the post and protrusion 66 of second clamp connector 67 to fit against the opposite side of the post. First and second bolts 34 and 32 are then passed, respectively, into the first and second receipt member apertures 59 and 62 of first clamp 16 and through first and second receipt member channels 42 and 44, as seen in FIG. 1, and are then screwed, respectively, into first and second bolt receipt threaded apertures 30 and 28 of first and second insert members 20 and 26, causing first and second clamps 16 and 18 to tighten around the post and be retained thereon. After first and second bolts 34 and 32 of both pairs of first and second clamps 16 are tightened, one side of wooden gate attachment member 104 can be attached to first clamp connector 36 by mounting screw 12 or equivalent means of attachment, passing through first clamp connector 36 into wooden insert 38, as seen in FIG. 4. Bracket 100 provided with safety gate 106 is then attached to the opposite side of wooden gate attachment member 104, according to the mounting instructions of the safety gate. Should a newel post have, for example, a rounded upper portion and a square lower portion, first and second round post adapters can be used with the first and second clamps attached to the rounded upper portion of the post and will not be used when securing the second pair of first and second clamps to the lower portion of the post. The first and second clamps of this invention are adjustable to the various widths and shapes of newel posts that are generally available.

Figure 5:
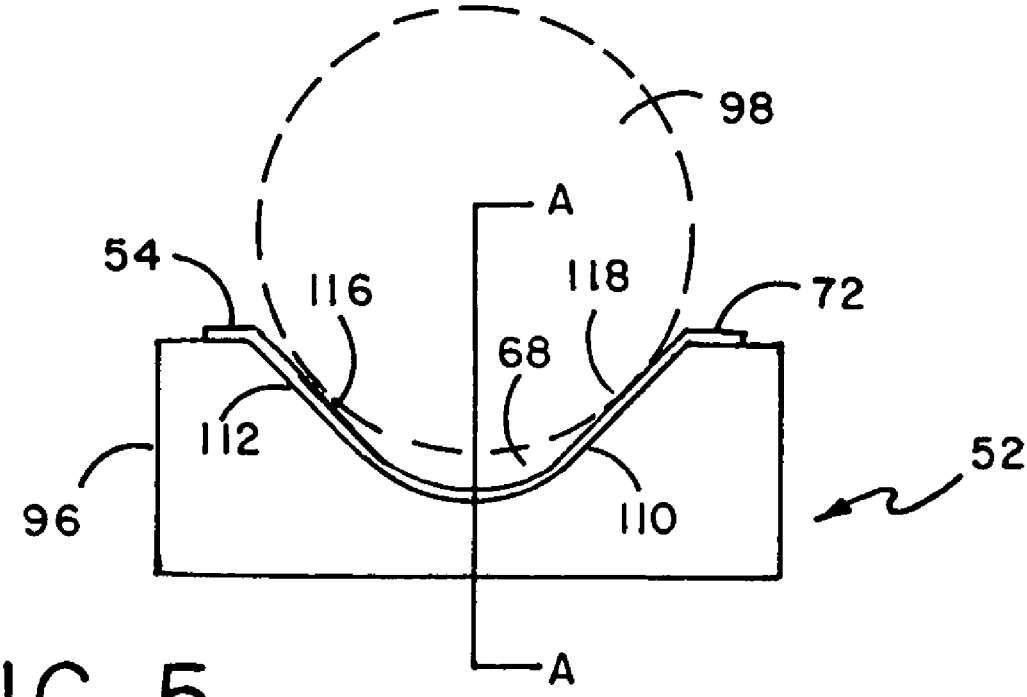
FIG. 5 illustrates a top plan view of a single round post adapter positioned against a round post.
Figure 6:
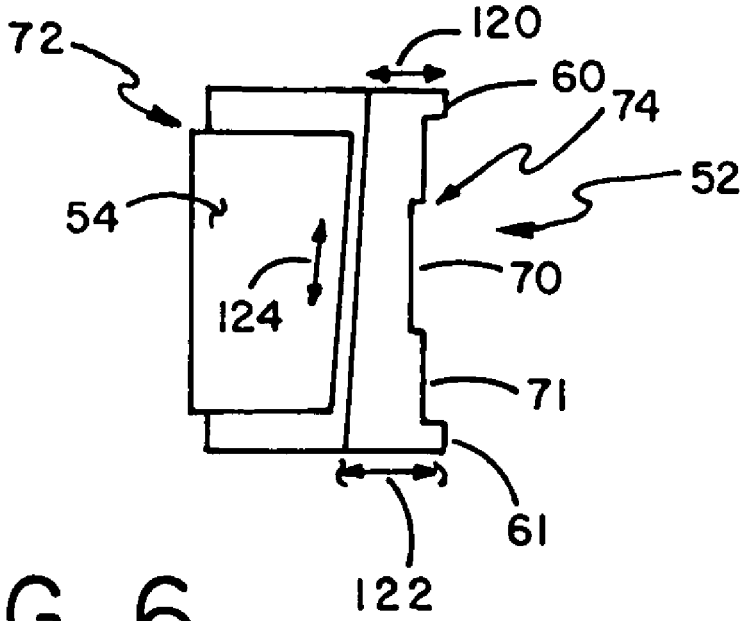
FIG. 6 illustrates a side cutaway view through A-A of the round post adapter of FIG. 5.

The substantially concave portion 68 of each round post adapter, such as seen in FIG. 5 which shows a top plan view of second round post adapter 50, can have generally straight sides, such as first straight side 110 and second straight side 112 which are joined by a curved portion 114. The advantage of the straight sides is that they will contact a round post, such as round post 98 shown in dashed lines in FIG. 5, at two points on each side of the post, being first and second contact points 118 and 116 which provide for better contact with round post 98 than if the post were merely to contact the round post adapter at one point such as is possible if the substantially concave portion 68 were semicircular. Further, the substantially concave portion 68 of the round post adapter is formed with a slight vertical angular slope for better positioning against a section of a post that has any angling or taper. FIG. 6, which is a side cutaway view through A-A of the round post adapter of FIG. 5, shows that the distance 122 at the base is greater than the distance 120 at the top, forming a vertical angular slope 124. This slope can be positioned either upwards or downwards depending upon the slope of the section of the round post 98 that it is to be positioned against so as to best make contact with the post.

Since some newel posts have different shapes along their lengths, and consequently different widths and diameters, from their top to their bottom, shims may be required to position wooden gate attachment member 104 at a perfect 90 degree angle to the floor. One or more shim members, not illustrated but well known in the prior art, can be included with the kit of this invention for interposing, for example, between wooden gate attachment member 104 and first clamp connector 36 so that newel posts of different sizes and shapes can be securely retained by first and second clamps 16 and 18 while allowing wooden gate attachment member 104 to be in a vertical position.

Although the present invention has been described with reference to particular embodiments, it will be apparent to those skilled in the art that variations and modifications can be substituted therefor without departing from the principles and spirit of the invention.

I claim:

1. A kit for use in the installation of a safety gate to a post, such safety gate having its own assembly/attachment hardware to a vertical surface, such post having a height, an upper portion and a lower portion, a first side and a second side disposed opposite to one another, said first and second sides each having a width, said portions each having a shape, said shape being either substantially circular or rectangular in horizontal cross-section, comprising:

a first pair of clamping members for attachment to said top portion of said post and a second pair of clamping members for attachment to said lower portion of said post, said first pair of clamping members and said second pair of clamping members each having:

a first clamp having:

a first clamp connector, said first clamp connector having an outer side, an inner side, a width, a height, a length, a first end and a second end;

a first receipt member and a second receipt member attached, respectively, to said first side and said second side of said first clamp connector at right angles thereto, said first and second receipt members each having a first end and a second end, said first ends disposed, respectively, adjacent to said first side and said second side of said first clamp connector, and said second ends disposed at said other ends of said first and second receipt members, said first and second receipt members each having an inner side facing inward, an outer side, and a length; said first and second receipt members having, respectively, a first receipt member aperture and a second receipt member aperture defined in said first ends, said first and second receipt members having, respectively, a first and second channel defined, respectively, in said inner sides, said channels extending a distance along said length of said first and second receipt members and forming open second ends, respectively, in said first and second receipt members, said first and second inner channels each having a inner height and an inner width, said first and second channels in communication, respectively, with said first and second receipt member apertures, said first clamp connector and said first and second receipt members forming a substantially U-shaped structure;

a second clamp having:

a second clamp connector, said second clamp connector having an inner side, an outer side, a top, a bottom, a width, a height, a first end and a second end, and a length defined between said first and second ends, said second clamp connector having a protrusion extending outward from said inner side, said protrusion having a height, a width, a length and a flat outer surface, first and second insert members extending at right angles, respectively, from said first and second ends of said second clamp connector, said first and second insert members and said second clamp connector forming a substantially U-shaped structure, said first and second insert members each having a length, a height, a width, an inner side and an outer side, and an second end disposed furthest away from said second clamp connector, said first insert member and said second insert members having, respectively, near their second ends a first bolt receipt threaded aperture and a second bolt receipt threaded aperture defined therein extending, respectively, along said length of said first and second insert members toward said second clamp connector, said first and second inner channels of said first and second receipt members each having an inner height and inner width greater than the outer height and outer width of said first and second insert members;

first and second bolt members each having threaded ends, said first and second bolt members for passing, respectively, through said first and second receipt member apertures and being screwed, respectively, into said first and second bolt receipt threaded apertures;

wherein said first and second insert members can be inserted, respectively, within said first and second channels of said first and second receipt members when said inner surface of said first clamp connector is placed adjacent to said first side of said post and said outer surface of said rectangular protrusion is placed adjacent to said second side of said post, said first and second clamps being tightenable against said first and second sides of said post by passing said first and second bolt members, respectively, through said first and second receipt member apertures and screwing them into said first and second bolt receipt threaded apertures when said first and second sides of said post are flat, said first and second clamps being adjustable to said width of said first and second sides of said post;

a vertically disposed wooden gate attachment member having a height, a lower portion and a upper portion, and first and second sides disposed opposite to one another, said wooden gate attachment member being substantially rectangular in horizontal cross-section, said first side of said wooden gate attachment member for positioning against said outer side of one of said first clamp connector at said upper portion of said wooden gate attachment member and against said outer side of the other first clamp connector at said lower portion of said wooden gate attachment member;

means for mounting said wooden gate attachment member to said outer side of one first clamp connector at said upper portion of said wooden gate attachment member and against said outer side of the other first clamp connector at said lower portion of said wooden gate attachment member; and wherein said safety gate can be attached to said second side of said wooden gate attachment member with said assembly/attachment hardware of said safety gate.

2. The kit of claim 1 further including:

at least one pair of first and second round post adapters for use when said first and second sides of said post are substantially circular in horizontal cross-section, said first and second round post adapters each having a height, a width, a top, a bottom, and first and second ends, the distance between said first and second ends of said first and second round post adapters being less than the distance between said inner sides of said first and second receipt members, said first and second round post adapters each having:

a first side member and a second side member positioned, respectively, on said first and second ends of said first and second round post adapters;

a first inner surface disposed between said first and second side members, said first inner surface having a substantially concave portion defined therein, said first inner surface for facing toward said one side of said post when said first and second round post adapters are in use;

a second outer surface disposed between said first and second side members, said second outer surface facing outward away from said post when said first and second round post adapters are in use;

an outer channel defined in said second outer surface between said top and said bottom of said round post adapter, said outer channel forming a upper lip near said top of said round post adapter and a lower lip near said bottom of said round post adapter;

an inner channel defined in said outer channel, said inner channel having a depth, a length and a width, said dimensions of said inner channel of a size to receive said protrusion of said second clamp connector therein; and wherein said first and second insert members can be inserted, respectively, within said first and second channels of said first and second receipt members, and said first and second round post adapters can be inserted between said substantially U-shaped first and second clamps with their first inner concave surfaces positioned up against opposite sides of said substantially circular post, with said protrusion of said second clamp connector disposed in said inner channel of said first round post adapter and said inner side of said first clamp connector disposed in said outer channel between said first lip and said second lip of said second round post adapter, said first and second clamps, being tightenable against said first and second sides of said post by passing said first and second bolt members, respectively, through said first and second receipt member apertures and screwing them into said first and second bolt receipt threaded apertures, said first and second clamps being adjustable to said width of said post.

3. The kit of claim 2 further including:

a first clamp connector aperture defined centrally in said inner side of said first clamp connector;

a wooden insert member for insertion into said first clamp connector aperture; and said means for mounting said wooden gate attachment member to said outer sides of said first clamp connectors comprises a first and second screw, said first and second screws for passing, respectively, through said upper and lower portions of said wooden gate attachment member and into said outer sides of said first clamp connectors and engaging, respectively, into their wooden inserts.

4. The kit of claim 3 wherein said first inner surface of each of said first and second round post adapters has a layer of resilient cushioning disposed thereon.

5. The kit of claim 4 wherein said outer surface of said second clamp connector protrusion has resilient cushioning thereon.

6. The kit of claim 2 wherein said substantially concave portion of each of said first and second round post adapters has a vertically angled inner surface between said top and said bottom of said round post adapter.

* * * * *